United States Patent [19]

Metzger

[11] 4,420,088

[45] Dec. 13, 1983

[54] ROTARY RAILROAD CAR COUPLER ASSEMBLY WITH A HORIZONTAL KEY/SLOT ARRANGEMENT

[75] Inventor: William J. Metzger, Willowick, Ohio

[73] Assignee: Midland-Ross Corporation, Cleveland, Ohio

[21] Appl. No.: 315,926

[22] Filed: Oct. 28, 1981

[51] Int. Cl.[3] ..... B16G 7/10; B16G 9/20

[52] U.S. Cl. ..... 213/50.5; 213/62 A; 213/67 A

[58] Field of Search ..... 213/50, 50.5, 62 R, 213/62 A, 67 R, 67 A, 69–72

[56] References Cited

U.S. PATENT DOCUMENTS

| | | | |
|---|---|---|---|
| 2,019,311 | 10/1935 | Kinne | 213/50 |
| 2,973,105 | 2/1961 | Metzger | 213/71 |
| 3,157,290 | 11/1964 | Kulieke | 213/62 A |
| 3,157,291 | 11/1964 | Kulieke et al. | 213/62 A |
| 3,220,563 | 11/1965 | Baker | 213/62 R |
| 4,243,149 | 1/1981 | DePenti | 213/69 X |
| 4,328,900 | 5/1982 | Hanula | 213/62 A |

*Primary Examiner*—Randolph Reese

*Attorney, Agent, or Firm*—Harlan E. Hummer

[57] ABSTRACT

A rotary F-type railroad car coupler is described as having a rotary connector which is mounted for rotation within a cylindrical opening in the front end of the yoke. The rotary connector has an opening which extends longitudinally through the connector for receiving the butt end of the coupler shank. A horizontal key/slot arrangement, rather than a vertical pin/pinhole-type connection, is provided to attach the car coupler to the rotary connector. The key has an oblong cross-section defined by two pairs of opposing surfaces which are convexly curved outwardly from the center axis of the key which also has a pair of opposing ends that are cylindrically shaped and not spherical, as are the ends of conventional cylindrical pins presently used to attach the butt end of the coupler shank to the rotary connector.

14 Claims, 3 Drawing Figures

ROTARY RAILROAD CAR COUPLER ASSEMBLY WITH A HORIZONTAL KEY/SLOT ARRANGEMENT

BACKGROUND OF THE INVENTION

The invention relates to rotary railroad car couplers, expecially rotary F-type couplers which employ vertically disposed cylindrical pins for attaching the butt end of the coupler shank to a rotary connector that acts as an intermediary member for rotatably fastening the coupler to the yoke of the rotary car coupler assembly which essentially includes the car coupler, striker, yoke, rotary connector and draft gear which are housed in the carsill that is attached to the underside of a railroad car.

There are non-rotary couplers of the E and F type, as described, for example, in U.S. Pat. No. 3,063,573, wherein a horizontal key is used to secure the butt end of the coupler shank directly to the yoke which is provided with a pair of horizontally aligned slots for receiving opposing ends of the key. All rotary F couplers use vertical pin attachments, if they employ pins for rotatably connecting the coupler to the yoke. The invention is directed to the adaptation of a horizontal key/slot connection of a non-rotating coupler to one that is rotatable.

Briefly stated, the invention is in a rotary railroad car coupler which employs a rotary connector for rotatably mounting the car coupler to the yoke. The rotary connector, when in a normal, unrotated operating position, has a pair of horizontally aligned slots that extend laterally from an opening which extends longitudinally through the connector and which is designed to receive the butt end of the coupler shank. The slots each have a generally oblong cross-section defined by two pairs of opposed surfaces which are convexly curved outwardly from the center axis of the slot and which are complimentary to the adjacent outer surfaces of a horizontal key which is used to fasten the coupler and connector together for unitary rotation. The key rests in the slots of the rotary connector and an aligned key slot which extends through the coupler shank adjacent the butt end.

The key slot of the coupler is horizontally disposed when the coupler is in a normal push/pull position, and is defined by a first pair of upper and lower surfaces which are configured and generally horizontally disposed to rockingly engage the adjacent curved surfaces of the key to increase vertical angling of the car coupler. The first pair of surfaces of the key slot of the coupler shank are connected by a second pair of opposed surfaces which are convexly curved outwardly from the center axis of the key slot and which are complimentary to the adjacent curved surfaces of the key to provide surface-to-surface bearing between the key and coupler shank, when the coupler is buff or pull, rather than the line-to-surface bearing between a cylindrical pin and a larger diameter pinhole.

The key has a pair of opposing ends which are cylindrically shaped and not spherical, as are the ends of the cylindrical pins presently used with rotary car couplers. The cylindrical end surfaces of the key provide better sliding contact and bearing against the adjacent cylindrical surfaces which form the cylindrical opening in the yoke.

As previously indicated, rotary railroad car coupler assemblies which utilize rotary connectors, employ cylindrical pins which are vertically disposed and have spherical ends. Such pins are maintained in position by a block that is secured within an opening in the yoke through which the pin is inserted into the aligned openings of the rotary connector and coupler shank. The jostling of the vertical pin and the retainer block during normal operation of the couplers in buff and pull, causes the block to wear in such a way that an offset develops between the worn block and adjacent yoke. This offset impedes the rotation of the coupler as the pin contacts the offset. The use of a horizontal key/slot arrangement, especially with a key having cylindrical and not spherical ends, eliminates this problem, since the horizontal key only contacts the retainer block upon rotation of the coupler 90° from its normal operating position, and then such engagement is surface-to-surface contact which is less apt to form an undersirable groove in the block.

DESCRIPTION OF THE DRAWING

The following description of the invention will be better understood by having reference to the accompanying drawing, wherein.

DETAILED DESCRIPTION OF THE DRAWING

Figure 1:
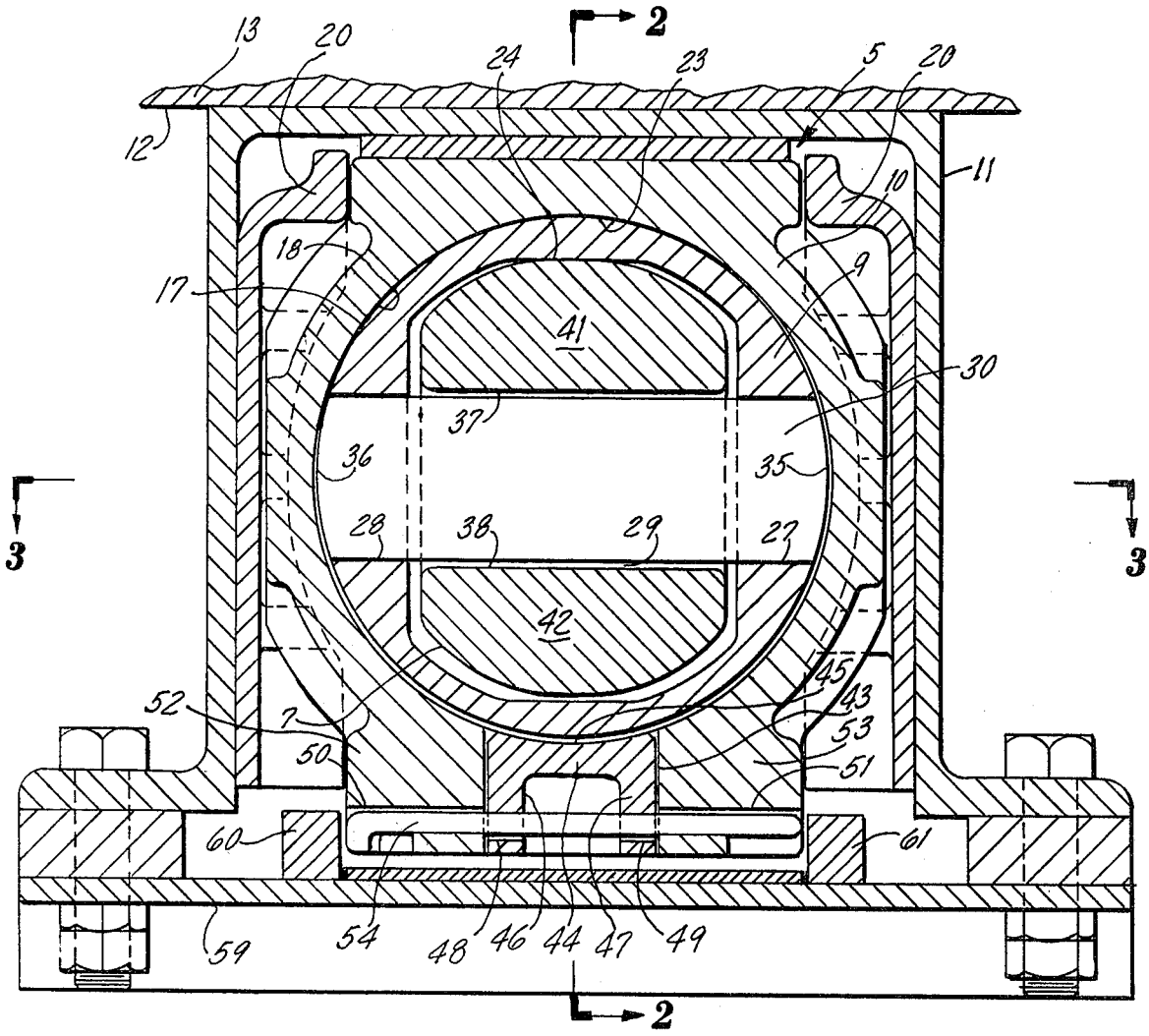
FIG. 1 is a transverse cross-section of a rotary railroad car coupler assembly which is made in accordance with the invention and viewed from the line 1—1 of FIG. 2.

With general reference to the drawing, there is shown a rotary railroad car coupler assembly 5 which, when in a normal, horizontal position, comprises an AAR standard F-type coupler head 6 with an attached shank 7 which extends horizontally from the coupler head and terminates at a butt end 8 that is pinned to a rotary connector 9 which is mounted for rotation within a yoke 10 that is secured within a standard carsill housing 11 which is attached to the underside 12 of a rail-road car 13.

The yoke 10 has a conventional pair of top and bottom straps 14, 15 which extend rearwardly from the front end 16 of the yoke 10 closest the coupler head 6. The front end 16 of the yoke 10 is provided with a cylindrical opening 17 which extends longitudinally of the yoke between the straps 14, 15 and is defined by an inner cylindrical surface 18. An annular collar or stop 19 extends into the opening 17 adjacent the front end 16 of the yoke 10 to engage and restrict axial movement of the rotary connector 9 in the direction of the coupler head 6.

A striker 20 at least partially surrounds the front end 16 of the yoke 10 and is provided with a set of similar stops 21 which are spaced from the annular stop 19 to contact and restrict axial movement of the rotary connector 9 in a direction away from the coupler head 6. It is appreciated by those skilled in the art that a conventional draft gear assembly, including a spring loaded front follower 22, also acts to restrain axial movement of the yoke 10 longitudinally of the housing 11.

The rotary connector 9 has a cylindrical outer surface 23 which has an outside diameter that is slightly less than the correspondingly measured inside diameter of the cylindrical opening 17 in the yoke 10. The rotary connector 9 is provided with an opening 24 which extends longitudinally through the connector and which is designed to receive the spherical butt end 8 of the coupler shank 7, which butt end extends through the rotary connector 9 and seats against a mating cavity 25 that is formed in the front follower 22 which is spring loaded in the direction of the coupler head 16 by any suitable means, e.g. a stack of rubber cushion pads 26 of the draft gear. The rotary connector 9 is provided with a pair of aligned horizontally disposed slots 27, 28 which extend laterally in opposite directions from the opening 24 in the rotary connector 9 for alignment with a slightly larger horizontal key slot 29 that is formed in the coupler shank 7 adjacent the spherical butt end 8, to receive a horizontal key 30 which is used to attach the coupler for unitary rotation with the rotary connector 9.

Figure 3:
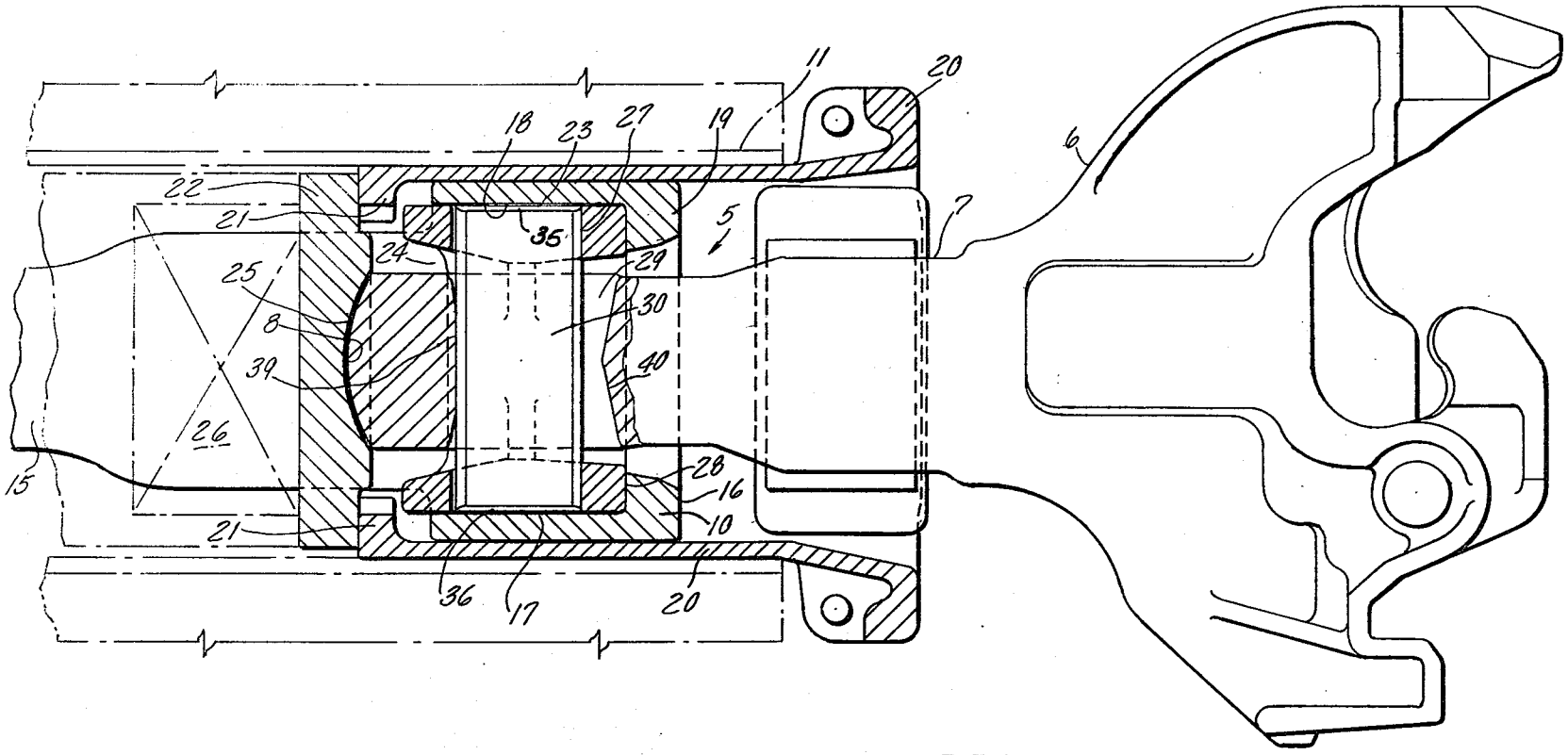
FIG. 3 is a section of the rotary railroad car coupler assembly viewed from the line 3—3 of FIG. 2.

The key 30 has a generally oblong cross-sectional configuration which is defined by (I) a first pair of oppositely disposed surfaces 31, 32 which are convexly curved outwardly away from the center axis of the key and formed on a 12 inch radius having a centerpoint on a plane containing said axis, and (II) a second pair of oppositely disposed surfaces 33, 34 which are also convexly curved outwardly away from the center axis of the key, but formed on a much smaller 2 inch radius taken from the center axis. The 4 inch oblong key 30 is equivalent, in length, to a 4 inch diameter cylindrical pin, shown in dotted line, as compared as a $3\frac{1}{2}$ inch diameter cylindrical pin which has heretofore been used in conjunction with rotary connectors. The 4 inch oblong key 30 has a section modulus which is as large as that of the conventional $3\frac{1}{2}$ inch diameter cylindrical pin, so that the strength of the key is at least the same as that of the $3\frac{1}{2}$ inch diameter pin. The key 30, as best seen in FIGS. 1 and 3, has a pair of opposing ends 35, 36 which are cylindrically shaped for better sliding engagement and bearing against the adjacent inner cylindrical surface 18 which defines the cylindrical opening 17 in the yoke 10, contrary to prior art horizontal keys or vertical pivot pins which generally have flat or spherical ends. The radius of curvature of the cylindrical key ends 35, 36 is the same, or slightly less than, the correspondingly measured radius of curvature of the adjacent outer cylindrical surface 23 of the rotary connector 9 and inner cylindrical surface 18 of the yoke 10 against which the key 30 rides during a dumping operation.

The cross-sectional shapes of the aligned slots 27, 28 in the rotary connector 9 are complimentary to the cross-sectional configuration of the key 30, i.e. there is about 1/16 inch clearance between the curved surfaces of the key 30 and similarly curved adjacent surfaces of the slots 27, 28 of the rotary connector 9. The shape of the key slot 29 that is formed adjacent the butt end 8 of the coupler shank 7, is quite different, however, having a first pair of opposing surfaces 37, 38 which are generally horizontally disposed and designed to rockingly engage the adjacent upper and lower curved surfaces 31, 32 of the key 30 to allow greater vertical angling of the coupler. The first pair of surfaces 37, 38 of the key slot 29 may be flat or have a slight curvature which is in the same direction, and not less than, the curvature of the adjacent surface 31, 32 of the key 30. The first pair of surfaces 37, 38 of the key slot 29 have adjacent opposing ends connected by a second pair of opposing surfaces 39, 40 which are convexly curved outwardly from the center axis of the key slot 29 and which are also formed on a 2 inch radius to be complimentary to the adjacent front and back curved surfaces 33, 34 of the key 30.

It can be appreciated by those skilled in the art, that the bearing between the key and coupler shank, when the coupler is in pull or buff, is equivalent to the effective bearing area between the coupler and a cylindrical pin of the same length, as previously described. The effective bearing area of the backside of a cylindrical pin, closest the butt end of the shank, for example, is theorized as being 75% of the circumferential length of the backside of the pin times the length of the pin contacting the coupler shank. The back and front sides of the key slot each have a radius of curvature which is equal to that of the adjacent back and front sides of the key, so that there is highly improved surface-to-surface bearing between the oblong key and the shank of a coupler in buff or pull, contrary to the more generally line-type contact between a cylindrical pin and larger diameter pinhole, the latter type contact producing undesirable bending stresses in the coupler shank adjacent the pinhole. Such stresses are eliminated or substantially reduced by the above described key-slot connection.

It can also be appreciated that, because of the horizontally elongated shape of the key slot 29, the top and bottom walls 41, 42 of the coupler shank adjacent the key slot 29, have a much greater thickness T and are, therefore, much stronger and less susceptible to fracturing and breakage from the increased stresses that are being imposed upon rotary railroad car coupler assemblies by large size railroad cars in service today. For example, the 4 inch oblong key 30 has a thickness of about 3 inches compared to the $3\frac{1}{2}$ diameter of the conventionally used cylindrical pin. Thus, the thickness of the top and bottom walls of the shank, adjacent the key slot, can be increased by about $\frac{1}{2}$ inch over the thickness of the sidewalls bordering a $3\frac{1}{2}$ inch diameter pinhole.

Figure 2:
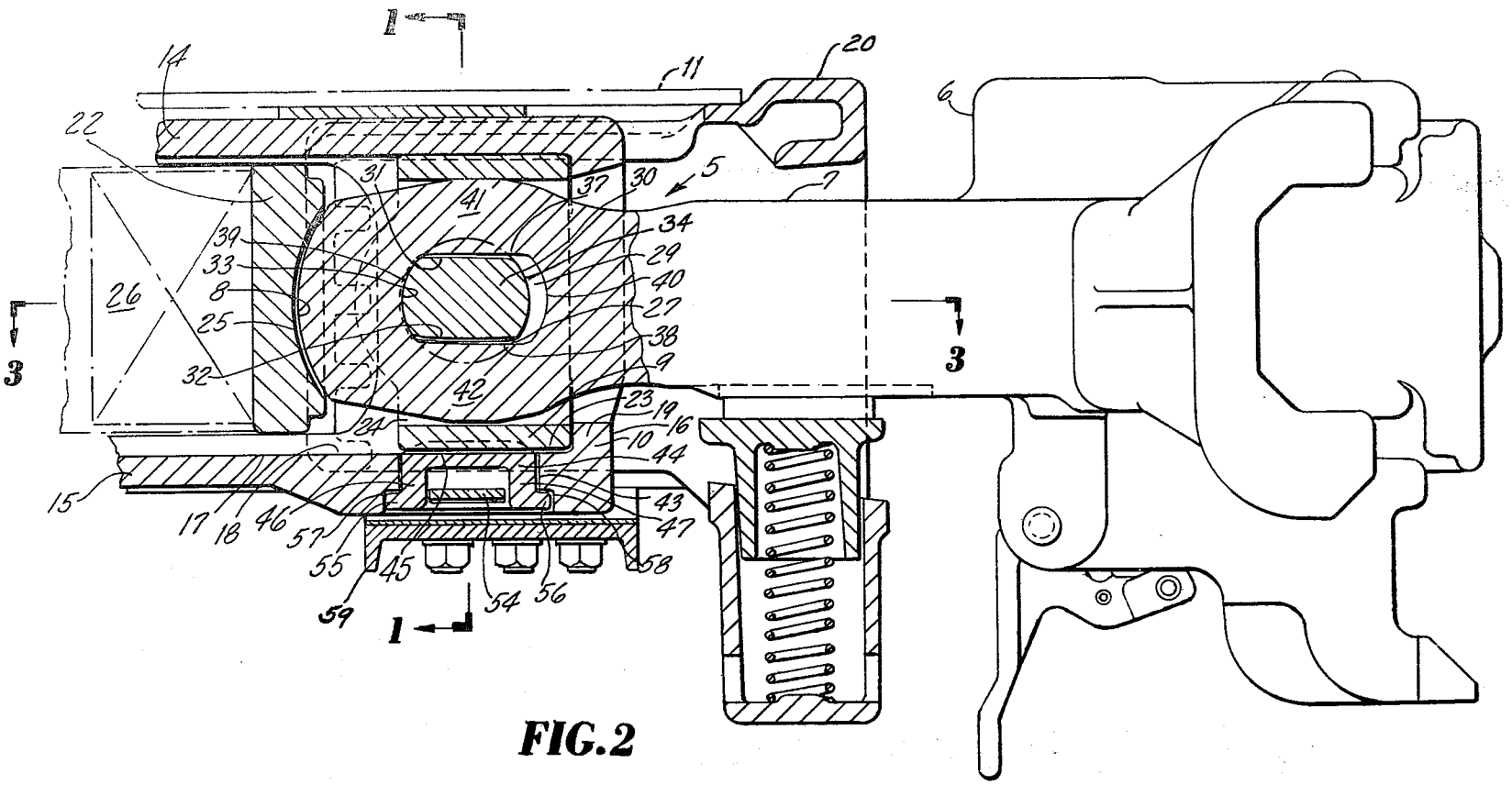
FIG. 2 is a section of the rotary railroad car coupler assembly viewed from the line 2—2 of FIG. 1.

The car coupler is mounted on the rotary connector, for example, by inserting the key 30 vertically upwardly through an opening 43 in the bottom of the yoke 10 into vertically aligned slots of the properly positioned rotary connector and coupler shank, after which the car coupler and attached rotary connector are rotated 90° to a normal operating position where the key 30 is in a generally horizontal position. It is desirable to close the opening 43 in the bottom of the yoke, since the coupler is normally rotated more than 90° during a dumping operation. This is accomplished by the use of a retainer block 44 which is mounted in the opening 43 in the bottom of the yoke 10. The retainer block 44 has a cylindrical concavity 45 which has the same radius of curvature as, the adjacent inner cylindrical surface 18 of the yoke 10, so that it blends in smoothly with the surface. The block 44 has a pair of downwardly extending, parallel legs 46, 47 with horizontally aligned pinholes 48, 49 that, in turn, are in horizontal alignment with a pair of pinholes 50, 51, which are formed in adjacent flanges 52, 53, of the yoke 10. A suitably shaped rod or L-shaped pin 54 is inserted in the aligned, matingly shaped pinholes 48-51 of the block and yoke to maintain the block firmly in position. The pin 54 has a rectangular cross-section, as best seen in FIG. 2. The retainer block 44 is provided with a pair of oppositely projecting wings 55, 56 which extend into matingly configured recesses 57, 58 that are formed in the bottom of the yoke 10 to limit vertical movement of the block 44. Thus, between the retainer pin 54 and the coaction of the wings 55, 56, the retainer block 44 is held firmly in position where the concavity 45 of the block 44 is matingly aligned with the inner cylindrical surface 18 of the yoke 10.

A cover 59 is bolted to the bottom of the housing 11 to close the opening therein and support the yoke 10. The cover 59 is provided with a pair of upstanding parallel stops 60, 61 which are in close proximity to adjacent portions of the yoke 10 and the farthest spaced opposing ends of the pinholes 50, 51 in the yoke 10 to prevent lateral movement of the yoke within the housing and retain the pin 54 in the aligned openings 48-51 of the block and yoke.

Thus, there has been described a key/slot arrangement for rotatably attaching an F-type car coupler indirectly to the yoke by means of an intermediary rotary connector to which the coupler shank is keyed. Such an arrangement permits strengthening the top and bottom walls bordering the key slot in the coupler shank without diminishing the effective bearing between the key and coupler. Further, the key is provided with upper and lower curved surfaces for rocking engagement with adjacent surfaces of the key slot in the coupler shank to provide better, less wearing contact between the key and coupler shank and greater vertical angling than key slot arrangements, wherein both the key and slots are provided with flat parallel surfaces. Also, the opposing ends of the key are provided are cylindrical in shape to provide surface-to-surface sliding engagement between the key and adjacent cylindrical wall of the yoke, when the coupler rotates.

What is claimed is:

1. A rotary railroad car coupler assembly which, when the coupler is horizontally disposed in a pull or buff position, comprises:

(a) a yoke having a cylindrical opening which extends longitudinally into the yoke from a front end of the yoke closest the head of an attached car coupler;

(b) a rotary connector mounted in the opening of the yoke for rotation about the rotational axis of the yoke, the connector having an opening which extends longitudinally through the connector and which communicates with a pair of horizontally aligned and oblong shaped slots which extend laterally from the opening in the connector, each slot defined by two pairs of oppositely disposed surfaces which are convexly curved outwardly from the center axis of the slot;

(c) means for restricting movement of the rotary connector longitudinally of the yoke;

(d) a car coupler having, a head which protrudes from the front end of the yoke for coupling engagement with another coupler, and a shank which is attached to the head and extends into the opening of the yoke and rotary connector, the shank having a butt end which extends through the opening in the rotary connector for seating engagement against a front follower which is spring loaded in the direction of the coupler head, the shank having a horizontally oblong slot extending therethrough adjacent the butt end thereof in horizontal alignment with the aligned slots in the rotary connector, the slot in the shank having a first pair of generally horizontally disposed surfaces which are connected at their opposing ends by a second pair of surfaces which are convexly curved outwardly from the center axis of the slot, the curvature of said connecting surfaces being complimentary to adjacent similarly disposed and curved surfaces of the slots in the connector;

(e) means for keying the coupler to the rotary connector for unitary rotation, including a key extending horizontally through the aligned slots of the shank and rotary connector, the key having a horizontally oblong cross-sectional configuration which is smaller in area than that of the slots, the key having two pairs of oppositely disposed surfaces which are convexly curved outwardly from the center axis of the key and which are complimentary to the curvature of the adjacent surfaces of the aligned slots of the rotary connector, the one pair of opposing curved surfaces being generally horizontally disposed and designed for rocking engagement with the similarly oriented first pair of surfaces of the slot in the shank to increase the vertical angling of the coupler, the key having a pair of opposing ends which are cylindrically shaped, as distinguished from prior art keys and cylindrical pins which have opposing ends that are flat or spherical.

2. The rotary railroad car coupler assembly of claim 1, wherein the shorter, more vertically disposed curved surfaces of the key are formed on a single radius which is substantially the same as the radius of the similarly disposed adjacent curved surfaces of the slot in the shank, so that when the coupler is in buff or pull, the key will bear against an adjacent surface of the slot substantially throughout its curved surface measured generally vertically of the key.

3. The rotary railroad car coupler assembly of claim 2, wherein the opposing curved surfaces of the key which rockingly engage the surfaces of the slot in the shank, are each formed on a single radius of about 12 inches.

4. The rotary railroad car coupler assembly of claim 3, wherein the coupler head includes an AAR standard F coupler head.

5. The rotary railroad car coupler assembly of claim 4, wherein the cylindrically shaped opposing ends of the key each have a radius of curvature which is not less than the radius of curvature of the adjacent outer cylindrical periphery of the rotary connector.

6. The railroad car coupler assembly of claim 5, wherein the radius of curvature of each of the cylindrically shaped ends of the key is substantially the same as the radius of curvature of the outer cylindrical periphery of the rotary connector.

7. The railroad car assembly of claim 1 or 6, wherein the yoke has a vertically extending opening through which the key is passed into aligned slots in the shank and rotary connector, and wherein means are provided for closing the opening to prevent the key from falling therethrough after the key is in position for fastening the coupler to the rotary connector, said means including:

(I) a block matingly configured to extend into the opening, the block having, (i) a cylindrical surface which blends in with the cylindrical opening in the yoke, and (ii) a pair of legs which extend downwardly from said cylindrical surface and have a pair of horizontally aligned pinholes therein;

(II) a pair of pinholes disposed in portions of the yoke adjacent the block, the pinholes in the block and yoke being in alignment, when the cylindrical surface of the block and opening of the yoke are in substantial blending alignment;

(III) a pin insertable in the aligned pinholes of the yoke and block, the pin and pinholes having matingly configured cross-sectional shapes; and (IV) means for keeping the pin in the aligned pinholes during rotation of the car to which the rotary railroad car coupler assembly is attached.

8. The railroad car coupler assembly of claim 7, wherein the pin and pinholes each have a rectangular cross-section, the pin and pinhole being substantially wider than they are high measured transversely to the width thereof, and the means for keeping the pin in the aligned pinholes, includes:

(V) a housing partially surrounding the yoke and having an opening therein adjacent the vertical opening of the yoke;

(VI) a cover closing the opening in the housing and covering the block and adjacent portion of the yoke containing the pinholes;

(VII) means for securing the cover to the housing;

(VIII) a pair of upstanding stops secured to the cover and extending therefrom along opposing sides of the yoke in close proximity of the farthest spaced opposing ends of the pinhole in the yoke for blocking the ends and exit of the pin from the pinholes.

9. The railroad car coupler assembly of claims 1, 6 or 8 wherein the first pair of surfaces of the slot in the shank each have a radius of curvature which is not less than the radius of curvature of the closest adjacent curved surface of the key which the first pair of surfaces of the slot in the shank rockingly engage.

10. The railroad car coupler assembly of claim 9, wherein the radius of curvature of each of the first pair of surfaces of the slot in the shank is infinite, such that said surfaces are flat and parallel to each other.

11. A non-rotatable pin block insertable in the bottom opening of a rotary railroad car coupler yoke to retain a key in the yoke, comprising:

(a) a curved pin block surface designed to be in cylindrical relation with an inner surface of a cylindrical opening disposed in the yoke when the pin block is properly positioned in the bottom opening of the yoke;

(b) a non-circular pin block body including at least two pairs of parallel legs extending from the curved surface of the pin block, the first pair of legs having between their opposing ends a pair of aligned pinholes with identical rectangular cross-sections, the aligned pinholes being aligned with adjacent similarly shaped pinholes in the yoke when the pin block is properly positioned in the bottom opening of the yoke, the second pair of legs terminating at distal ends which have a pair of wings which extend laterally from the pin block into matingly configured recesses that extend laterally from the bottom opening of the yoke, when the pin block is properly positioned in the bottom opening of the yoke;

(c) a pin insertable in the aligned pinholes, the pin having a similar, but smaller cross-section than those of the pinholes, the pin coacting with the wings to limit axial movement of the pin block in the bottom opening of the yoke in a direction to and from the cylindrical opening in the yoke, whereby the curved surface of the pin block is maintained in substantial cylindrical alignment with the adjacent cylindrical surface of the yoke.

12. The pin block of claim 11, which includes means for blocking the farthest spaced opposing ends of the pinhole in the yoke when the pin is inserted therein to maintain the pin in the pinholes.

13. The pin block of claim 12, wherein the pinholes and pin are dimensioned so that the pin block first engages the pin as the block moves in a direction away from the cylindrical opening of the yoke, and the wings and mating recesses are dimensioned so that the wings of the pin block first engage the yoke as the block moves in the direction of the cylindrical opening of the yoke.

14. The pin block of claim 12 wherein said means for blocking includes a yoke cover fastened to a yoke housing, said cover including a pair of unstanding parallel stops which prevent lateral movement of the yoke ans simultaneously retain said pin in the aligned pinholes provided in said block and the yoke.

* * * * *